US005890290A

United States Patent [19]

Davis

[11] Patent Number: 5,890,290

[45] Date of Patent: Apr. 6, 1999

[54] ADJUSTABLE DEPTH SAFETY CUTTER

[76] Inventor: Raymond E. Davis, 2601 Market St., Garland, Tex. 75041

[21] Appl. No.: 906,047

[22] Filed: Aug. 5, 1997

[51] Int. Cl.[6] ..... B20B 1/08

[52] U.S. Cl. ..... 30/2; 30/162

[58] Field of Search ..... 30/2, 151, 162, 30/286, 289, 293, 294, 142, 143

[56] References Cited

U.S. PATENT DOCUMENTS

| | | | |
|---|---|---|---|
| 2,291,075 | 7/1942 | Hanson | 30/2 |
| 2,376,887 | 5/1945 | Walters | 30/286 |
| 2,644,230 | 7/1953 | Anderson | 30/151 |
| 2,686,969 | 8/1954 | Furey | 30/2 |
| 2,695,447 | 11/1954 | Maynard | 30/2 |
| 2,730,800 | 1/1956 | Bailey | 30/2 |
| 2,743,523 | 5/1956 | Honey | 30/286 |
| 4,012,836 | 3/1977 | Baer et al. | 30/2 |
| 4,086,698 | 5/1978 | Sparks | 30/2 |
| 4,091,537 | 5/1978 | Stevenson, Jr. | 30/286 |
| 4,503,612 | 3/1985 | Davis | 30/2 |
| 4,744,146 | 5/1988 | Schmidt | 30/162 |
| 4,868,985 | 9/1989 | Rehm | 30/162 |
| 5,502,896 | 4/1996 | Chen | 30/162 |
| 5,613,300 | 3/1997 | Schmidt | 30/2 |

OTHER PUBLICATIONS

Dennison Super Safe Cutters; 1 page flyer; undated.

Martor–Ruck–Zuck No. 55337; 1 page flyer; undated.

*Primary Examiner*—Hwei-Siu Payer

*Attorney, Agent, or Firm*—Locke Purnell Rain Harrell

[57] ABSTRACT

An improved carton cutter has an incrementally extendable fully retractable first cutting blade with a depressible safety guard at its front end. A strap cutting second blade is fixed at a hooked rear end of the cutter. A ratchet mechanism provides audible evidence of the amount of blade extension and a pointer shows the position of the front blade. The front blade is mounted on a lockable slide. Both blades are easily removable without disassembly and precisely positioned without noticeable play.

25 Claims, 4 Drawing Sheets

ADJUSTABLE DEPTH SAFETY CUTTER

BACKGROUND OF THE INVENTION

1. Field of the Invention

The invention relates to a cutting device, more particularly a box or cardboard cutter.

2. Background of the Art

Although the cutter of the invention has numerous uses, its most prominent use would be in the grocery industry where those charged with stocking shelves must open cartons sometimes referred to as "shippers" which contain a number of individual boxed products which are placed on shelves for retail sale.

Both fixed blade and adjustable blade box cutting knives are known in the art. Sharp blades are required for efficient opening of cartons. Despite the spring-like guards on some carton cutters, such as the resiliently deflectable springs of U.S. Pat. No. 4,503,612, there remains a serious threat of cuts which can probably never be completely eliminated as long as sharp blades are employed. Most guards are a step in the right direction and are improved upon in the present invention.

A significant problem for grocery stores and consumers arises from the lack of depth control and lack of positioning control which results from the use of conventional cutters. A very significant percentage of damage in grocery stores occurs because of these factors. Stocking personnel cut through the carton into the product boxes which are generally made from paperboard and easily cut. Present regulations prohibit the sale of retail boxes that have been partially opened which increases the cost associated with the problem. In addition, some boxes include plastic strapping which must be cut. Plastic strapping on cartons is difficult to cut efficiently with a conventional box cutter. Although specially shaped cutters are known for strap cutting, they are a separate tool which requires the stockers to have both tools available and the blades are not efficiently arranged. Additional cost and efficiency loss is associated with discovery by a worker at one end of the store that the cutter he needs is at the other end of the store. These problems and more are solved by the improved box cutter of the present invention.

SUMMARY OF THE INVENTION

The invention is a combination carton cutter and strap cutter in one implement with improvements in both cutters. The invention has an elongated body having a front end portion with a cutting face, an intermediate handle section and a rear end portion. A blade holding slide is mounted preventing for linear movement within the body. A knife holding head on the slide extends and retracts through an opening in the cutting face. A resilient member continually tends to retract the slide. A manually operated slide button on the blade holding slide extends from a side opening in the intermediate handle section and includes a first locking mechanism which selectively locks the slide in a desired fixed position by movement of a locking button. The locking and unlocking buttons are collocated such that blade holding slide can be extended and locked in one quick motion with the thumb.

A second locking button engages the slide in a holding position in a plurality of extended positions of the blade holding head with respect to the cutting face. This is accomplished by means of a series of rearwardly facing teeth which engage the front edge of the locking button which itself is pivotally mounted and spring loaded to press its front in contact with the teeth. When the slide moves out, the second locking button merely rides over the rearwardly facing teeth on the blade holding slide. When the slide button is released, a spring pulls the slide back such that the closest tooth engages the second locking button which holds the blade in one of a plurality of extended positions. Depressing the second locking button immediately releases the slide for complete retraction.

A spring loaded knife guard extends from an opening in the cutting face in front of the knife holding head. A cantilevered detent in the body allows the user to frictionally engage the bar-like safety guard and keep it from extending beyond the cutting face for special circumstances where it is inconvenient to have the safety guard in place. The safety guard remains extended in front of a cutting knife placed on the cutting head until it is depressed by placement of the cutter against a surface to be cut.

The knife holding head has a knife blade holding side having the combination of a flat area to support the side of a blade, at least one button post extended away from the flat portion for being received in an opening of the blade and a hooked upper edge slot which receives and holds an upper edge portion along the blade whereby the blade is held in position on the blade holding head without any significant play. The front cutting blade is both quickly and easily removable yet precisely positioned. Part of the body slidingly rests against the exposed side of the blade thereby holding the knife blade on the blade holding head. When the slide is fully extended, the knife blade comes free from the body portion so it is easy to remove, reverse or replace.

The front end portion of the body is equipped with a pair of oppositely positioned slidable ear-like edge guides, one of which may be extended beyond the cutting face by the thumb of a right or left handed user to laterally position the knife holding head with respect to the edge of a box. This prevents the knife blade from reaching retail boxes in a carton even if the knife is extended too far. The ear-like edge guards provide a way to precisely control the positioning of the knife blade on the knife holding head in a lateral position with respect to the edge of the box. Mirror image disk-like slidable extensions are mounted on the left and right hand side of the front end portion of the body so that one of them may be used with the thumb of a right handed or a left handed person. They are used by slidingly extending them with the thumb. The device may be used without the side guides. Therefore, the same device may be used equally successfully by left or right handed people.

The hooked shaped rear end portion comprises a pivotable cap which opens and closes, the hooked portion having an internal slot for closely accepting an elongated second knife blade which is preferably identical with the first knife blade used at the front. The pivotable cap includes a stop wherein the knife blade can be held in a fixed cutting position within the hooked portion by contact with the stop when the cap is closed. The knife blade simply slides in and out of the hooked end portion and is securely held in place by a ramp on the pivotable cap which closes against a rearwardly exposed portion of the blade. Unlike conventional strap cutters, the blade is mounted mainly in the curved hook portion facing a base portion connected to the handle. When the hook is placed over a strap, the blade lies under the strap and cuts from the underside unlike conventional hook cutters. The cutting action is enhanced and facilitated by pulling the handle which simultaneously adds tension to the strap and creates movement between the bottom surface of the strap and the edge of the knife blade to quickly and efficiently sever tough straps.

The ratcheted slide which carries the knife blade to extend beyond the cutting face provides a means for precisely extending the blade in increments which are both visually and audibly distinct. The preferred embodiment extends the knife blade in ⅛" increments which are noticeable by an audible click as the second locking button passes over each successive tooth on the slide. A pointer on the slide button and a scale on the body show the given and repeatable position of the knife blade.

Conventional cutters require blades to be held with screws that must be removed and replace and are easily lost. Both the front and rear blades of the invention are held precisely and securely without the use of any screws or removable fasteners. This makes it possible to change the blade or reverse the trapezoidal blade without the need for tools.

DETAILED DESCRIPTION OF THE PREFERRED EMBODIMENT

Figure 1:
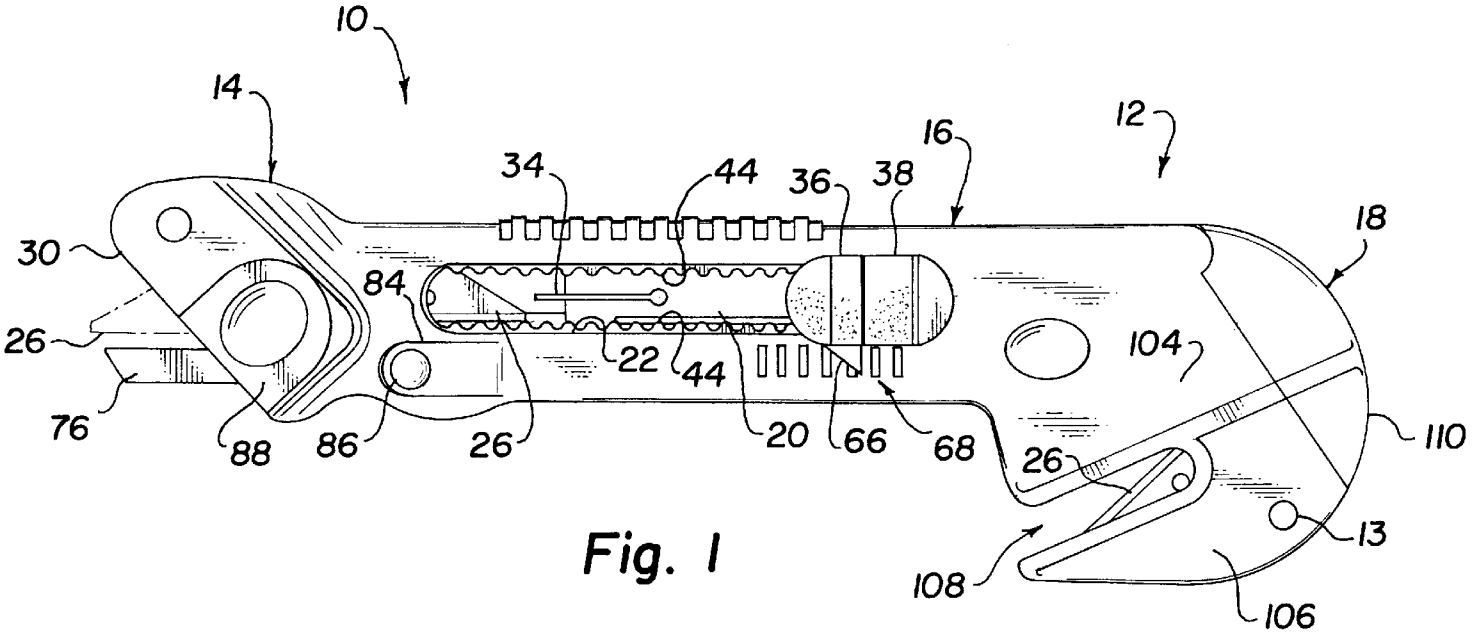
FIG. 1 is side view of the preferred embodiment of the invention seen from the left side thereof showing the thumb operated slide button.
Figure 2:
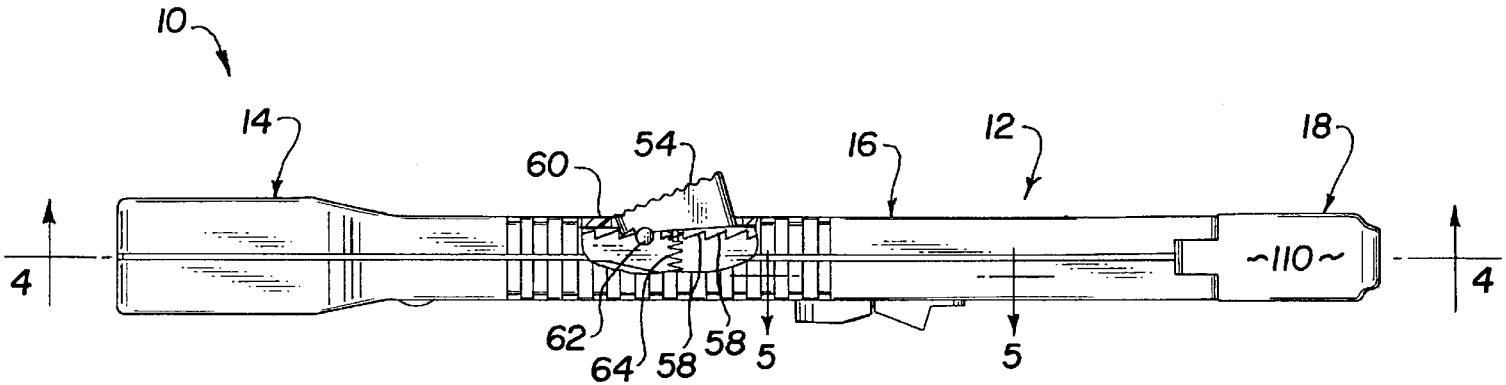
FIG. 2 is a top view of the invention of FIG. 1 showing the second locking button.

The safety cutter of the invention is referred to generally by the reference numeral 10 in FIG. 1. Cutter 10 has an elongated body 12 comprising a front end portion 14, an intermediate handle section 16 and a rear end portion 18. Body 12 is preferably made in two mating halves split along the parting line 4—4 seen in FIG. 2. Adjustability of the depth of cut is provided with a blade holding slide.

Figure 4:
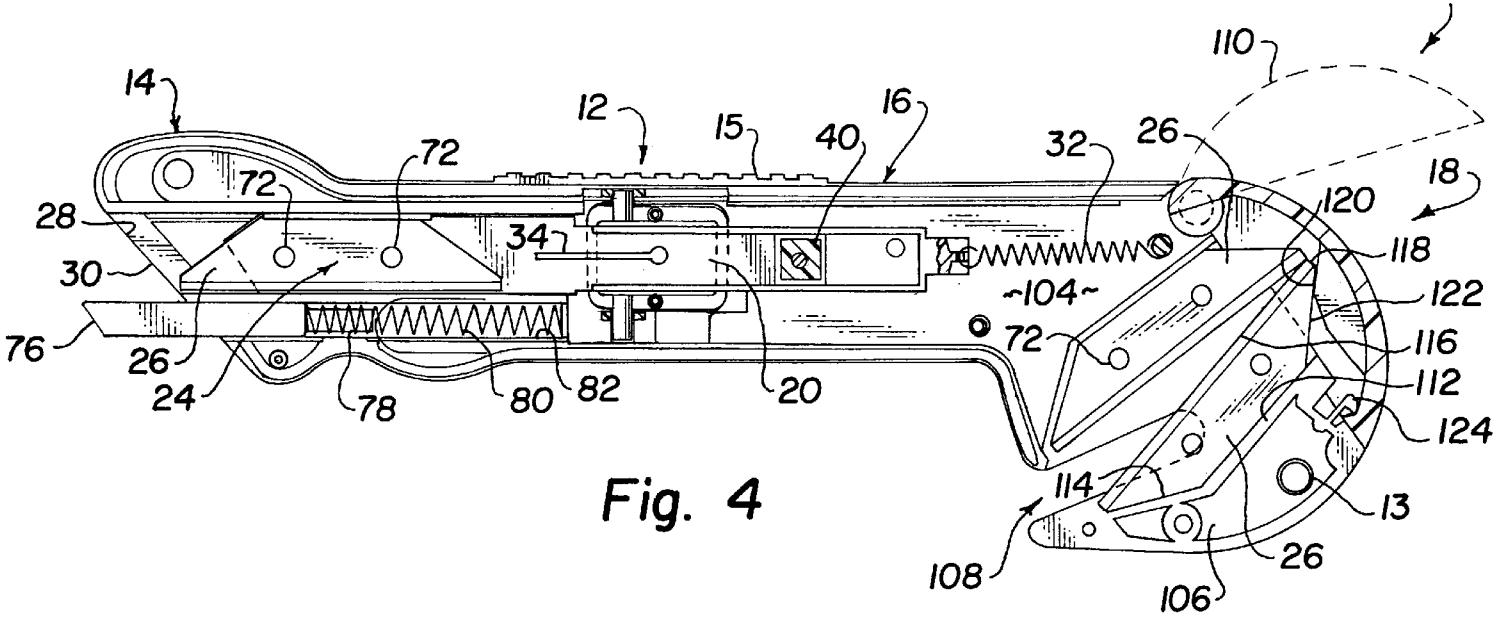
FIG. 4 is a side view along the lines 4—4 of FIG. 2 of a split half of the invention of FIG. 1 seen from the right side thereof.

Blade holding slide 20 is seen in FIG. 1 through the elongated opening 22 formed in the left side part of body 12. A more complete view of blade holding slide 20 is seen in FIG. 4. Blade holding slide 20 is mounted for linear movement with respect to body 12. Knife holding head 24 on slide 20 is adapted to precisely retain a knife blade 26 by a means which is discussed later.

Knife holding head 24 extends and retracts through an opening 28 in FIG. 4 of a cutting face 30. Cutting face 30 is a flat surface at the end of front portion 14 which is pushed against the surface of the carton to be cut. Although it is preferably a flat surface as shown in FIG. 1, it could be an arcuate surface.

A resilient member 32 in FIG. 4 is attached to the rear end of blade holding slide 20 which tends to keep knife holding head 24 retracted with respect to cutting face 30 as shown in FIG. 4. The inner surfaces of the split halves of body 12 are provided with a number of longitudinally extending walls and grooves in which slide 20 moves which are omitted for clarity in the drawings. Slide body 20 may also be fitted with grooves or raised portions such as raised portion 34 which help guide it during linear movement and/or may serve as stiffeners.

Figure 5:
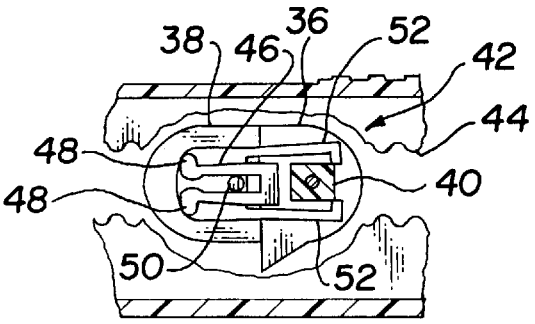
FIG. 5 is a partial cut away view along the lines 5—5 from FIG. 2 of the first locking mechanism hidden under the slide button seen in FIG. 1, with the mechanism in the unlocked position.

A manually operated slide button 36 and a companion first locking button 38 seen in FIG. 1 extends from side opening 22 in intermediate handle portion 16. Slide button 36 is preferably connected to slide 20 at a stem 40 seen in FIG. 4 fitted into a walled opening and fastened with a screw. A first locking mechanism generally designated 42 best seen in FIGS. 5 and 6 utilizes toothed edge or edges 44 of opening 22. Slide button 36 and first locking button 38 come together at a common side in the preferred embodiment. U-shaped spreadable arms 46 having detents 48 on its ends are also fixed to slide button 36.

Figure 6:
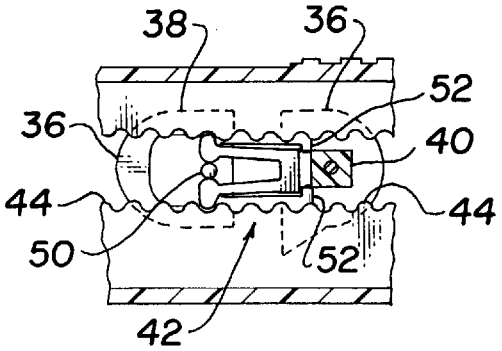
FIG. 6 shows the spreadable arms of the first locking mechanism of FIG. 5 in the locked position.
Figure 7:
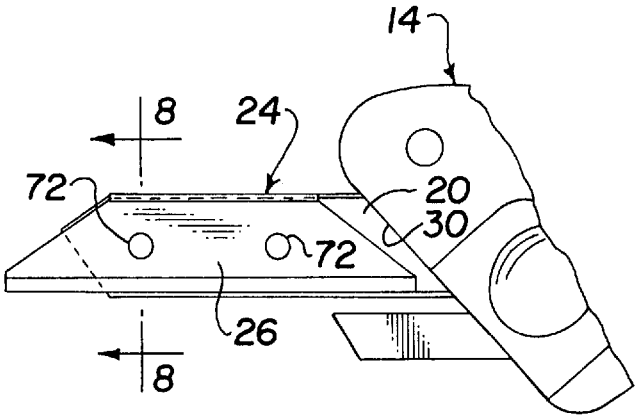
FIG. 7 is a view showing the blade holding slide fully extended forwardly from the cutting face to illustrate the positioning of a knife blade on the knife holding head.

Locking button 38 contains perpendicular post 50 which is effective to spread the U-shaped arms such that detents 48 engage opposed valleys between the teeth of tooth edges 44 in a rigid fashion. Smaller detents on the inside part of detents 48 may be utilized to create a snap over condition when locking button 38 is pulled back away from the slide button to lock. Note that locking button 38 has a pair of opposed hooked arms 52 which ride along the surface of stem 40 until the full extension is reached whereby the hooked portions of arms 52 engage the closed part of the "U" of the U-shaped spreadable arms 46. This prevents locking button 38 from moving any further away from slide button 36 than required. When the first locking mechanism in FIG. 6 is engaged with the edges 44 of body 12, slide 20 is locked and can move neither forward nor back. If the locking button is returned to its position in FIG. 5, slide 20 is unlocked.

There is a second locking button on the opposite side of body 12 which engages and holds the slide in an extended position . Best seen in FIGS. 2 and 3, second locking button 54 extends through an opening 56 in the opposite half of body 12. The opposite side of blade holding slide 20 from the view of FIG. 4 has a series of uniformly spaced teeth 58 which extend over a considerable length of slide 20. By reference to FIG. 2, second locking button 54 has a contact edge 60 in front. Locking button 54 is pivotally mounted at 62 in body 12 and resiliently loaded by a pair of springs 64, one on each side, which control the degree of forcefulness applied to pivot second locking button 54 against slide 20. It can easily be seen that when slide button 36 is pushed forward, teeth 58 do not engage contact surface 60 and locking button 54 merely rides along the surface of the backwardly pointing teeth. However, when slide button 36 is released, spring 32 pulls the closest tooth of the slide back against contact surface 60 locking the blade in its extended position. The degree of resilient locking force applied to second locking button 54 and the shape and size of the engagement teeth and contact surface 60 are selected to provide an audible click for each incremental extension of the slide so that the operator can hear each toothed extension of the knife holding head. An audible click is produced as slide 20 moves forward over each tooth. For example, three clicks from a rest position may represent the cutting depth for a single wall box while four clicks represents the knife extension required for a double wall box. In the preferred embodiment each click represent a ⅛" extension.

When locking button 54 is depressed, contact surface 60 disengages from its tooth on slide 20 and slide 20 is completely released to retract fully behind cutting face 30. Slide button 36 has a pointer 66 which travels over a scale 68 on body 12. Scale 68 is preferably arranged in concert with teeth 58 such that each click over a tooth represents one division on scale 68. This way precise known cutting depth beyond face 30 can be known by the operator either visually or without looking if he knows where the blade was with respect to the cutting face before it was extended.

Figure 8:
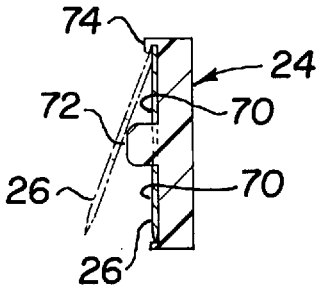
FIG. 8 is a view of the knife holding head and a knife blade seen along the lines 8—8 in FIG. 7 showing rotation of the blade for installation or removal in dotted outline.

Blade 26 is held with precision in a special way upon knife holding head 24 on slide 20 yet is easily replaceable and reversible. As evident in FIG. 8, knife holding head 24 has flat surfaces 70 on the blade holding side which support the flat side of blade 26. One or more short laterally extending projections 72 extend through corresponding openings in blade 26. The upper edge of blade 26 is fitted in an overhanging hooked upper ledge 74 which hangs over surfaces 70 to capture the upper edge of blade 26. Installation of blade 26 is accomplished by placing the upper edge of the trapezoidal shaped blade into overhanging ledge 74 then sliding the blade longitudinally until the openings are aligned with projections 72 and pressing the blade flat against surface 70. During use, only part of the blade extends beyond cutting surface 30 so that the blade is prevented from moving laterally or coming off knife holding head 24 by contact with suitably configured portions of front end portion 14. There is no noticeable play in the knife blade.

A spring loaded knife guard 76 is best understood by reference to FIG. 4. Knife guard 76 has a partially extended block portion which has a rectangular cross section. A spring holding stem 78 which is conveniently circular to support the front end of spring 80, which is confined in a spring groove 82 formed in the mating parts of body 12. Parts are shown in the neutral position so that the position of FIG. 4 is the relaxed position of the spring. Thus, guard 76 extends through an opening in cutting face 30 in front of blade 26 of knife holding head 24. As cutting face 30 is brought against the side of a carton, knife guard 76 is forced back into spring groove 82 and spring 80 is compressed ready to pop the guard back out immediately if the knife slips. A means for temporarily and deliberately holding guard 76 in a retracted position behind cutting face 30 is provided by means of a cantilevered arm 84 with a thumb boss 86 in FIG. 1 which may be depressed to frictionally engage the side of guard 76. The side of guard 76 may be roughened to facilitate frictional holding. As soon as boss 86 is released, guard 76 immediately extends to the safety position shown in FIG. 1.

Figure 3:
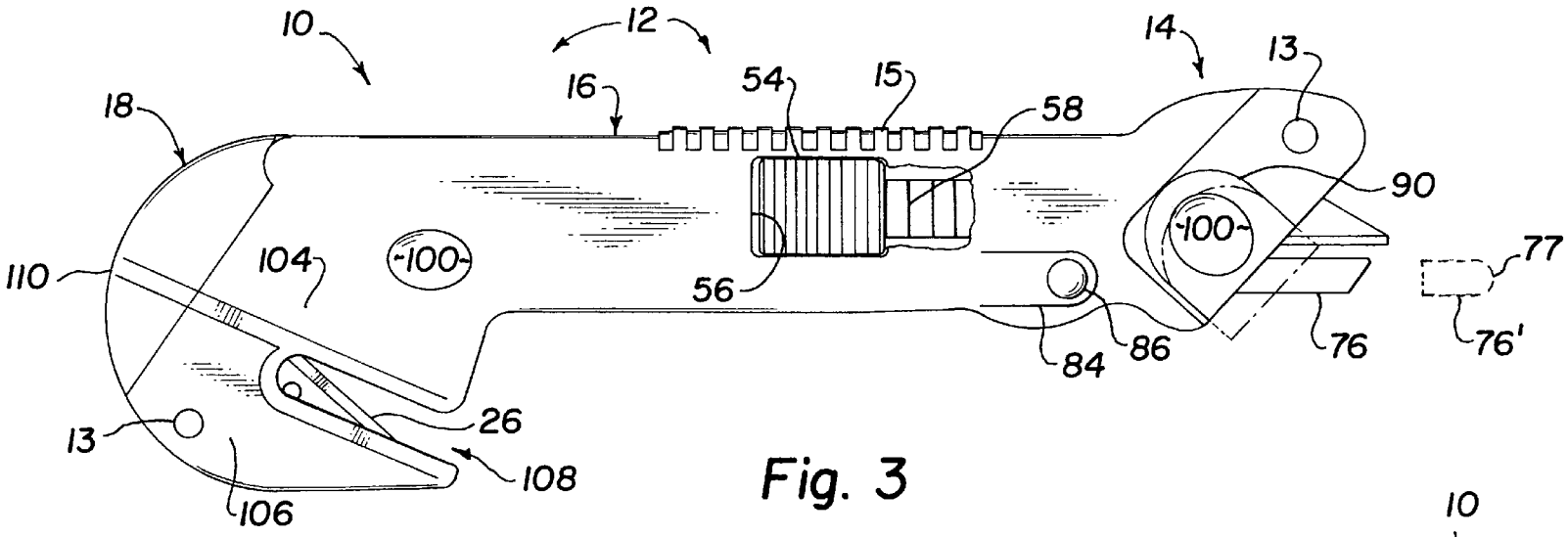
FIG. 3 is a side view of the invention of FIG. 1 seen from the right side, with part of the blade holding slide shown in a cut away view.

An improvement of knife guard 76 is represented in dotted outline in FIG. 3 as knife guard 76'. Knife guard 76' is like knife guard 76 in all respects except the outer end is rounded off preferably in a curve 77. Although the sides are still flat, the guard 76, 76' could also be cylindrical with a hemispherical rounded outer end. Rounding off the outer end has some advantages. Friction is reduced so the cutter slides easier, depression of the guard is easier no matter the angle of the cutter and there is lessened tendency for the guard to hang up on a creased area or damaged part of a carton to be cut.

Figure 9:
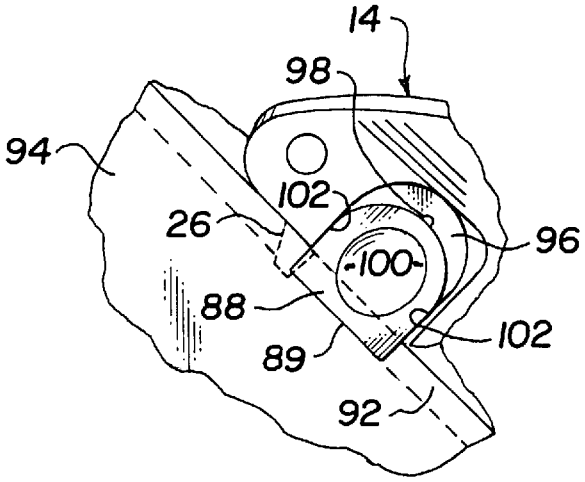
FIG. 9 is a cut away perspective view of the front end portion of the safety cutter with an ear-like left edge guide slidingly extended beyond the cutting face to laterally position a knife blade with respect to the edge of a box.

The adjustable depth safety cutter 10 as seen in FIGS. 1 and 3 is equipped with a pair of slidable edge guides 88 on the left side and guide 90 on the right side. One of these edge guides 88, 90 may be extended beyond cutting face 30 by a right or left handed user to laterally position the blade holding head and knife 26 with respect to the edge of a box. The dotted line position of side guard 90 in FIG. 3 is the extended position of the guard. The use of edge guide 88 is illustrated in FIG. 9 where edge guard 88 is shown in the extended position as it slides along an edge 92 of carton 94. A preferable amount of extension beyond the cutting face is about ¼ inch.

As seen in FIG. 9, in opposed arrangement on either side of front end portion 14 are a pair of uniform flat depressions 96 which have straight sides and a rounded back edge to form a flat bottom equipped with a groove 98 in the floor of depression 96. Grooves 98 extend in the direction of motion of ear-like edge guides 88, 90. Each edge guide has a saucer-like depression 100 to facilitate movement with the thumb of a right or left handed user as the case may be.

Edge guides 88, 90 are disk-like elements of generally uniform thickness having a rounded back edge, straight side edges and a straight or curved front edge 89 seen in FIG. 9. The bottom surface of disk-like elements 88, 90 is generally flat to slide along the flat bottom of depression 96 but provided with a post perpendicular to the surface which fits into groove 98 to prevent edge guides 88, 90 from sliding forward too far. The side edges 102 of depression 96 are provided with cavities extending parallel to groove 98 and the corresponding sides of edge guides 88, 90 are provided with linear protrusions which fit the cavities of edges 102 or vice versa. Edge guides 88, 90 may be forcefully placed over the depression 96 so that the post will be received in groove 98 and then forcefully pushed into place spreading the material sufficiently so that the corresponding grooves and protrusions on the edges of the depression and the disk-like edge guides are forced into sliding engagement. There is enough play in the fiberglass reinforced nylon plastic material from which the handle is made to allow force fitting of the edge guides in place. Once they are force fit in place, the post in groove 98 prevents the edge guides from being slid in a direction parallel to groove 98 much beyond the position in FIG. 9. The protrusions on the edges of edge guide 88, 90 being received in grooves of edges 102, prevent lifting of the edge guides unless it is done with considerable force. Thus, the edge guides once installed remain in place. When the edge guides 88, 90 are not extended as shown in FIG. 9, they are retracted so that the front edge 89 does not extend beyond cutting face 30 or forms a part thereof. There is enough frictional engagement between front end portion 14 and edge guides 88, 90 that they tend to remain in the extended or retracted position respectively of FIGS. 9 and 1 unless moved by the thumb. An opening 13 may be provided at the front or rear for use in hanging the cutter. Grips 15 may be molded into the intermediate handle section.

A rear end portion 18 of body 12 is hooked and configured for holding a fixed blade 26 oriented for cutting straps by using leverage of the handle section. Rear end portion 18 includes a base portion 104, a hook portion 106 and an open throat 108 which contains angularly oriented blade 26. A one piece pivoting cap 110 is pivotally connected to base 104 and swings out to the dotted position shown in FIG. 4. Of significance is the fact that rear end portion 18 has its blade 26 oriented with the edge facing inward from the hook rather than being on the opposite side as is conventional. The cutting edge of blade 26 is exposed at an angle within throat 108 of hooked portion 106. Knife blade 26 in use is placed in a closely fitting pocket in hooked portion 106. The pocket has walls 112, 114 and 116 in one split half of body 12 wherein the blade is pressed upon by suitable bosses or flat surfaces of the other split half. The rear end portion 118 of blade 26 extends back into the area which is exposed when cap 110 is open to the dotted line position. Note that a ramp 120 on the inside of cap 110 presses against a part of the trapezoidal edge 122 of knife 26 thereby fixing it precisely and securely within the closely fitting edges 112, 114, 116 when cap 110 is closed. Cap 110 is held by latch 124. No posts are used in openings 72 as was done in the case of knife blade 26 located at the front portion of cutter 10. Knife blade 26 simply slides in and out. Since the cap is what really secures cutting knife 26 in place, it is evident that by opening the cap, a used cutting blade 26 may be removed simply by grasping the rear end of blade 26 when the cover is removed. There is room for a spare blade 26 which is held in a pocket in part 104.

Figure 10:
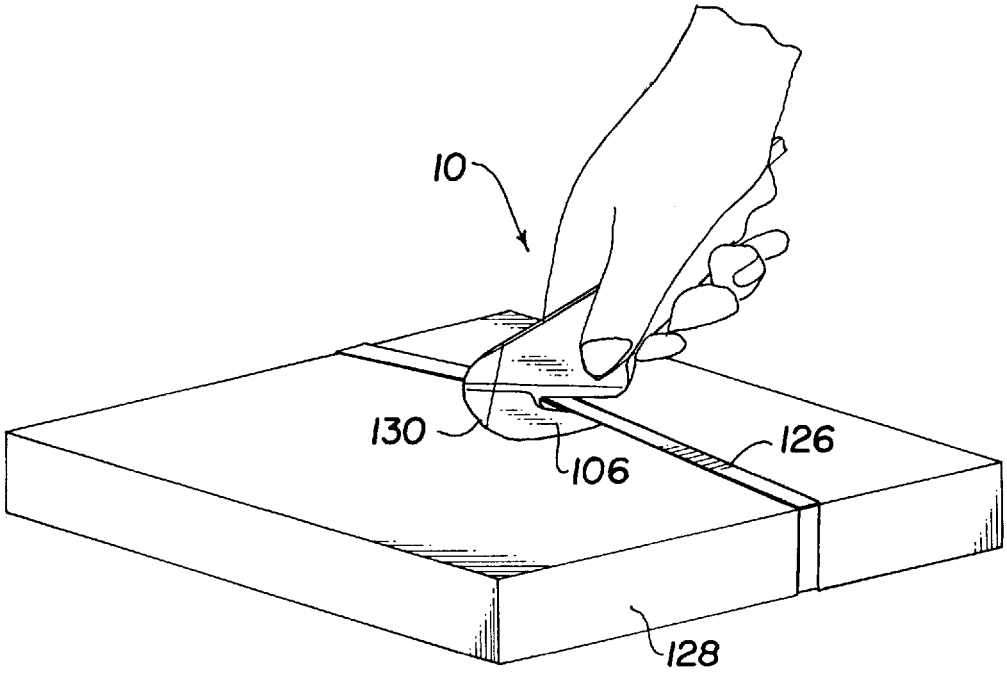
FIG. 10 is a perspective view illustrating how the hooked rear end portion of the body holding a fixed blade is used in cutting straps using leverage of the handle section.

FIG. 10 illustrates the use of hooked portion of cutter 10 to cut plastic straps 126 on a box 128. It may be noted that knife blade 26 is on the bottom of the strap with the edge up. The extreme rear contour of rear end portion 18 has a curve 130 which causes the edge of knife 26 to automatically move forward and up with respect to strap 126 by pulling up on the intermediate handle portion, which additionally raises the strap from the box, increasing tension in the strap. Inevitable movement of the strap with respect to edge of knife 26 resulting from this action provides an efficient quick severing of strap 126 from the bottom up rather than from the top down. The hook part of the cutter is useful for cutting tight film on shrink wrapped pallets.

In the preferred embodiment, cutter 10 is preferably molded from 30% glass filled nylon which provides good strength and durability with suitable die molding characteristics. Good wear resistance is particularly important because the device is in contact with abrasive of cardboard surfaces. The composition should be tough and strong but not brittle.

I claim:

1. An adjustable depth safety cutter for boxes comprising:

an elongated body having a front end portion with a cutting face, an intermediate handle section and a rear end portion;

a blade holding slide mounted for linear movement in the body, the slide having a knife holding head which extends and retracts through an opening in the cutting face and a resilient member attached to the slide which tends to keep the knife holding head retracted with respect to the cutting face;

a manually operated slide button on the blade holding slide which extends from a slide opening in the intermediate handle section and includes a first locking mechanism which selectively locks the slide in a desired locked position and has an unlocked position which allows the slide to move linearly;

a second locking button which engages the slide in a holding position which holds the slide in a plurality of extended positions of the knife holding head with respect to the cutting face and a release position which releases the slide for retraction; and a depressible spring loaded knife guard extending from an opening in the cutting face in front of the knife holding head.

2. The adjustable depth safety cutter of claim 1 wherein the front end portion of the elongated body is provided with an edge guide along the cutting face for laterally positioning the knife holding head with respect to an edge of a box.

3. The adjustable depth safety cutter of claim 2 wherein the edge guide is a thumb operated guide which is slidingly mounted on the front end portion of the elongated body for movement between a first position in which the guide is not extended from the cutting face and a second position in which the guide has a portion extended beyond the cutting face thereby laterally positioning the knife holding head with respect to the edge of a box.

4. The adjustable depth safety cutter of claim 1 wherein the knife holding head has a knife blade holding side having the combination of a flat area to support a side of a blade, at least one button post extending away from the flat area for being received in an opening in the blade and a hooked upper edge slot which receives and holds an edge portion along the blade whereby the blade is held without significant play in position on said head.

5. The adjustable depth safety cutter of claim 4 wherein a portion of the elongated body is configured to press against the exposed side of a knife blade mounted on said head as the blade holding slide is retracted in order to support the blade in its position of use.

6. The adjustable depth safety cutter of claim 5 wherein the rear end portion is hooked and configured for holding a fixed blade oriented for cutting straps by using leverage of the handle section.

7. The adjustable depth safety cutter of claim 1 wherein the knife guard has an outer end portion which is rounded to improve sliding and depression of the guard when the cutter is used to cut a carton.

8. An adjustable depth safety cutter for boxes comprising:

an elongated body having a front end portion with a cutting face, an intermediate handle section and a rear end portion;

a blade holding slide mounted for linear movement with respect to the body, the slide having a knife holding head which extends and retracts through an opening in the cutting face and a resilient member attached to the slide which tends to keep the knife holding head retracted with respect to the cutting face;

a manually operated slide button on the blade holding slide which extends from a slide opening in the intermediate handle section;

a second locking button which engages the slide in a holding position which holds the slide in any of a plurality of extended positions of the knife holding head with respect to the cutting face, said locking button having a release position which releases the slide for retraction; and a depressible spring loaded knife guard extending from an opening in the cutting face in front of the knife holding head.

9. The adjustable depth safety cutter of claim 8 wherein the rear end portion is hooked and configured for holding a fixed blade oriented for cutting straps by using leverage of the handle section.

10. The adjustable depth safety cutter of claim 8 wherein the slide has a plurality of engagement teeth in contact with the second locking button and the second locking button is resiliently loaded to engage the engagement teeth one at a time in the holding position whereby the slide can be extended incrementally and held in the extended position until the second locking button is released.

11. The adjustable depth safety cutter of claim 10 wherein the degree of resilient locking of the second locking button and shape and size of the engagement teeth are selected to provide an audible click for each incremental extension of the slide so that an operator can determine a cutting depth without looking.

12. The adjustable depth safety cutter of claim 11 wherein the body is provided with a scale and a pointer that moves with the slide to indicate an absolute slide position.

13. The adjustable depth safety cutter of claim 11 wherein the front end portion of the body is equipped with a pair of slidable edge guides one of which may be extended beyond the cutting face by a right or left handed user to laterally position the knife holding head with respect to an edge of a box.

14. The adjustable depth safety cutter of claim 8 wherein the manually operated slide button includes a first locking mechanism which selectively locks and unlocks the slide.

15. The adjustable depth safety cutter of claim 14 wherein the first locking mechanism has arms connected to a locking button, which can be moved into contact with the elongated body to lock the slide in a selected position.

16. The adjustable depth safety cutter of claim 15 wherein the front end portion of the body is equipped with a pair of slidable edge guides one of which may be extended beyond the cutting face by a right or left handed user to laterally position the knife holding head with respect to an edge of a box.

17. The adjustable depth safety cutter of claim 16 wherein the rear end portion is hooked and configured for holding a fixed blade oriented for cutting straps by using leverage of the handle section.

18. The adjustable depth safety cutter of claim 17 wherein the hooked rear end portion has a base portion connected to the handle section and a hooked portion connected to the base portion; and the fixed blade is primarily mounted in the hooked portion with its cutting edge facing the base portion and cutting from the bottom of a strap when the handle section is pivoted with a strap in the hooked portion for cutting.

19. The adjustable depth safety cutter of claim 8 wherein the knife guard has an outer end portion which is rounded to improve sliding and depression of the guard when the cutter is used to cut a carton.

20. An adjustable depth safety cutter for boxes comprising:

an elongated body having a front end portion with a cutting face, an intermediate handle section and a rear end portion;

a blade holding slide which is mounted for linear movement with respect to the body, said slide having a knife holding head which is selectively movable to at least partially extend from the cutting face at the front end portion of the body; and at least one slidable edge guide which is slidingly mounted at the front end portion of the elongated body for movement between a first position in which the guide is not extended from the cutting face and a second position in which the guide has a portion extended beyond the cutting face thereby providing a guide for lateral positioning of the knife holding head with respect to an edge of a box.

21. The adjustable depth safety cutter of claim 20 in which said at least one edge guide is a pair of ear-like edge guides slidingly mounted spaced apart on opposite sides of the front end portion of the body wherein they may be extended beyond the cutting face by a right or left handed user to laterally position the knife holding head with respect to the edge of a box.

22. The adjustable depth safety cutter of claim 20 further including a depressible spring loaded knife guard extending from an opening in the cutting face in front of the knife holding head.

23. The adjustable depth safety cutter of claim 22 wherein the knife guard has an outer end portion which is rounded to improve sliding and depression of the guard when the cutter is used to cut a carton.

24. The adjustable depth safety cutter of claim 20 wherein the rear end portion is hooked and configured for holding a fixed blade oriented for cutting straps by using leverage of the handle section.

25. The adjustable depth safety cutter of claim 24 wherein the hooked portion comprises a pivotable cap which opens and closes, the hooked portion having an internal slot for closely accepting an elongated knife blade; and the pivotable cap includes a stop wherein a knife blade can be held in fixed cutting position in the hooked portion by contact with the stop when the cap is closed.

* * * * *